US006796380B2

(12) United States Patent
Xu

(10) Patent No.: US 6,796,380 B2
(45) Date of Patent: Sep. 28, 2004

(54) HIGH EXPANSION ANCHOR SYSTEM

(75) Inventor: Yang Xu, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 13 days.

(21) Appl. No.: 10/223,168

(22) Filed: Aug. 19, 2002

(65) Prior Publication Data

US 2004/0031606 A1 Feb. 19, 2004

(51) Int. Cl.[7] ..... E21B 4/18; E21B 23/08
(52) U.S. Cl. ..... 166/381; 166/206; 175/99
(58) Field of Search ..... 166/381, 50, 206, 166/243, 383, 241.1, 216; 175/99

(56) References Cited

U.S. PATENT DOCUMENTS

| | | | | |
|---|---|---|---|---|
| 3,661,205 A | | 5/1972 | Belorgey | |
| 3,664,416 A | | 5/1972 | Nicholas et al. | |
| RE32,831 E | | 1/1989 | Shonrock et al. | |
| 5,005,642 A | * | 4/1991 | Moore | 166/241.5 |
| 5,186,254 A | | 2/1993 | van Staden | |
| 5,355,950 A | * | 10/1994 | Zwart | 166/241.6 |
| 5,358,039 A | * | 10/1994 | Fordham | 166/241.1 |
| 5,358,040 A | * | 10/1994 | Kinley et al. | 166/241.3 |
| 5,758,723 A | * | 6/1998 | Saucier et al. | 166/55.8 |
| 5,765,640 A | | 6/1998 | Milne et al. | |
| 5,785,125 A | * | 7/1998 | Royer | 166/380 |
| 5,794,703 A | * | 8/1998 | Newman et al. | 166/381 |
| 6,089,323 A | | 7/2000 | Newman et al. | |
| 6,220,348 B1 | | 4/2001 | Serafin et al. | |
| 6,311,778 B1 | | 11/2001 | Carisella et al. | |
| 6,318,461 B1 | | 11/2001 | Carisella | |
| 6,629,568 B2 | * | 10/2003 | Post et al. | 166/382 |

FOREIGN PATENT DOCUMENTS

EP 0281737 A1 1/1988

OTHER PUBLICATIONS

Aker Maritime, "High Expansion Brudge Plug," Brochure, 7 pages, date unknown.

* cited by examiner

*Primary Examiner*—Frank Tsay
(74) *Attorney, Agent, or Firm*—Steve Rosenblatt

(57) ABSTRACT

An anchor system for high expansion applications is described. It features a gripping member that holds together a pair of links. The movement of the links is regulated to assure the gripping member moves into proper contact with the casing. Meshing gears or a pin and slot can do this, for example. The gripping member is shaped such that it can still transmit load through the links even if the pin connections fail. The gripping member is preferably contoured to the shape of the casing inner wall to enhance grip.

22 Claims, 2 Drawing Sheets

HIGH EXPANSION ANCHOR SYSTEM

FIELD OF THE INVENTION

The field of this invention is anchor systems for well tools and, more particularly, high expansion bridge plugs or packers.

BACKGROUND OF THE INVENTION

Well tools frequently need to be anchored in casing for proper operation. In situations where the tool has to be delivered through tubing and set in casing, the anchor assembly must extend substantially from the run in position to grab the casing. This happens because the tool must be no bigger than a small dimension to be run smoothly through tubing and yet must expand substantially in percentage terms to grab the casing. In the case of a plug or packer, substantial directional forces are transmitted to the anchor system when such tools are set.

The designs of anchor systems in high expansion service have shown limited abilities to retain grip and some have released their grip under load. Generally these designs involve a release when the wickers on the end of a link that contacts the casing simply shear and the grip is lost. In the past, high expansion anchor systems involved rotating individual links that engage the casing with wickers mounted on an end. Examples of this design are U.S. Pat. Nos. 6,311,778 and 6,318,461. A through tubing design using similar anchor assemblies is shown in U.S. Re 32,831. In applications where high expansion is not an issue, the known technique of pushing slips out with cones has been employed, as shown in U.S. Pat. No. 6,220,348.

The problem with past designs is that they had a limited grip area due primarily to their layout of having wickers at the end of a thin link engage the casing wall. Even though multiple links would get independently actuated around the periphery of the packer or plug, the links were narrow and their grip limited for that reason. Even a plurality of such individual links could not support a tool in extreme loading conditions. What is needed and provided by the present invention is a way to increase the bite area of the gripping member that engages the casing wall. This has been accomplished in part due to the placement of the gripping member at the intersection of a plurality of links as well as controls built into the linkage to control the final movement of the gripping surface. Provisions for pin connection failure have been made so that the anchor of the present invention could still retain a grip if such a connection weakened or failed under heavy load. These and other advantages of the present invention will be more apparent to one skilled in the art from a review of the description of the preferred embodiment and the claims below.

SUMMARY OF THE INVENTION

An anchor system for high expansion applications is described. It features a gripping member that holds together a pair of links. The movement of the links is regulated to assure the gripping member moves into proper contact with the casing. Meshing gears or a pin and slot can do this, for example. The gripping member is shaped such that it can still transmit load through the links even if the pin connections fail. The gripping member is preferably contoured to the shape of the casing inner wall to enhance grip.

DETAILED DESCRIPTION OF THE PREFERRED EMBODIMENT

Figure 2:
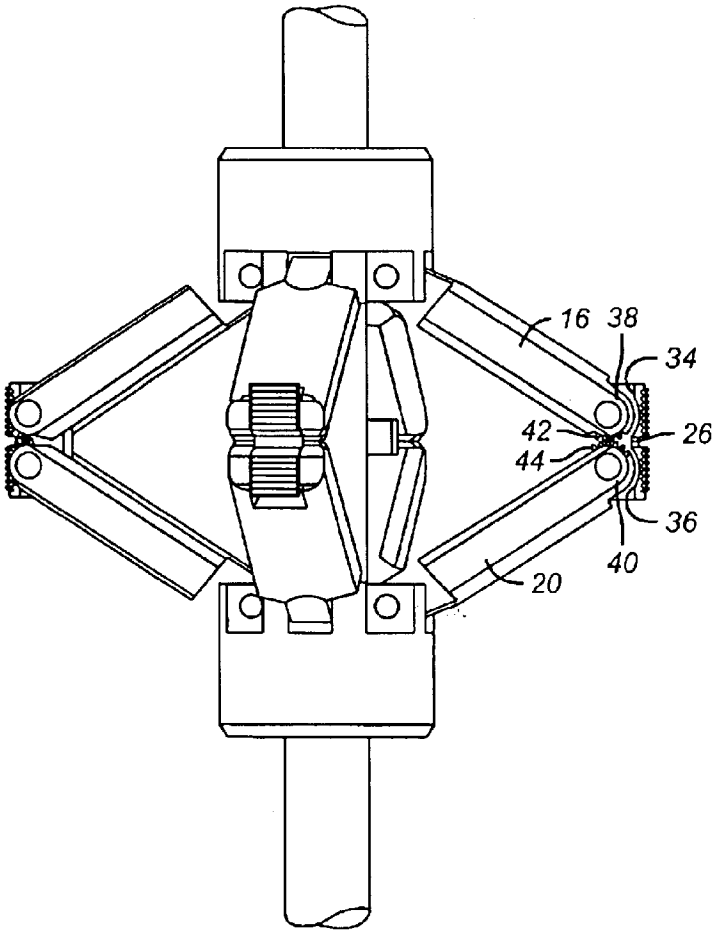
FIG. 2 is the view of FIG. 1 in the set position.
Figure 1:
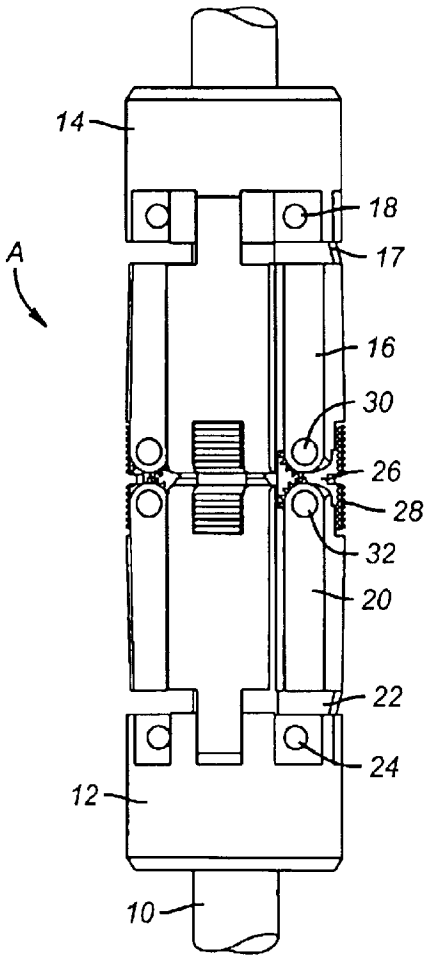
FIG. 1 is the run in position of the anchor using gears between the links.

Referring to FIG. 1, only the anchor assembly is illustrated with it being understood that it can be a part of any downhole tool that needs anchoring. The tool will generally have a mandrel 10 with a lower hub 12 and an upper hub 14. One of those hubs will move in tandem with the mandrel 10 while the other will be held stationary, during the setting procedure. In the embodiment illustrated in FIGS. 1 and 2, the upper hub 14 is movable toward the stationary lower hub 12. There is a plurality of anchor assemblies A, and only one will be described with the understanding that the others are preferably identical to it. Each assembly A has an upper link 16, pivotally mounted at its upper end 17 to upper hub 14 by a pin 18. Lower link 20 is pinned at its lower end 22 to lower hub 12 by pin 24. Slip 26 has wickers 28 for contacting the casing (not shown). Link 16 is pinned to slip 26 by pin 30. Link 20 is pinned to slip 26 at pin 32. Referring to FIG. 2, slip 26 has rounded interior areas 34 and 36 to accept ends 38 and 40 of links 16 and 20 respectively in the event of weakening or failure of either of pins 30 or 32. Additionally, ends 38 and 40 feature meshing gears 42 and 44 so that the movement of links 16 and 20 is tied together to ensure that the slip 26 comes out flush against the casing (not shown). The gears 42 and 44 remove a degree of freedom for the slip 26 and prevent it from changing the relative positions of pins 30 and 32 as the links 16 and 20 rotate into the position shown in FIG. 2.

Figure 4:
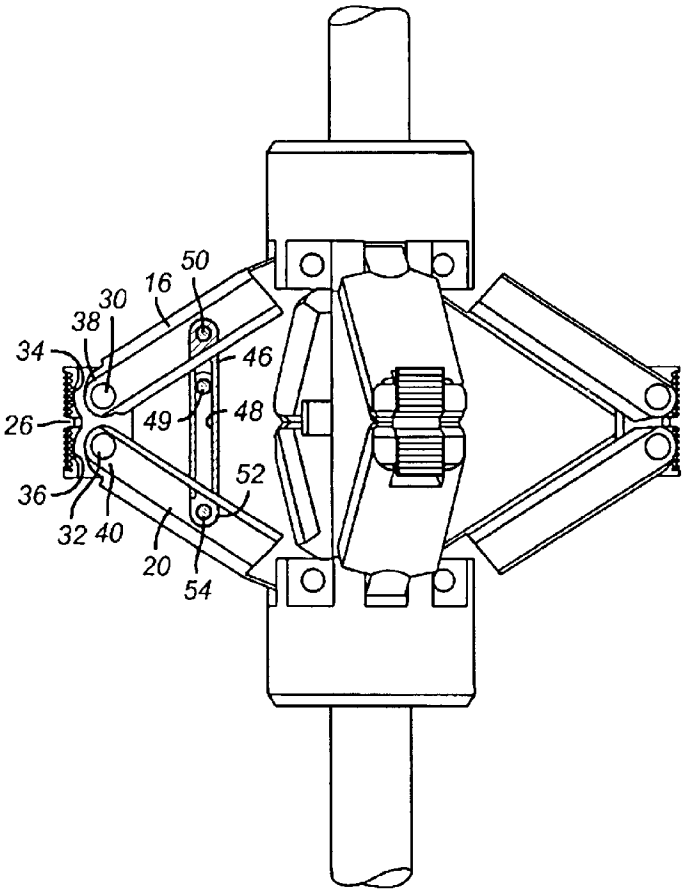
FIG. 4 is the view of FIG. 3 in the set position.
Figure 3:
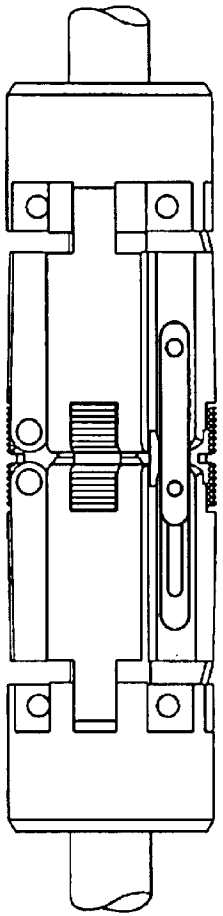
FIG. 3 is an alternative embodiment of FIG. 1 shown in the run in position.

As an alternative to gears 42 and 44, FIGS. 3 and 4 illustrate another way to insure the flush contact of the casing wall by slips 26. FIG. 3 shows the run in position, but the operation of the alternative design can be more easily seen in FIG. 4. In this embodiment, there are no gears 42 and 44. Instead, pinned to link 16 is guide link 46 that has a slot 48. Pin 50 provides the connection to link 16. Inserted in slot 48 is pin 49 of guide link 52, which is connected, by pin 54 to link 20. With this arrangement, the movements of links 16 and 20 are kept equal as hub 12 moves toward hub 14. This ensures that slip 26 will engage the casing in a flush manner. The rounded areas 34 and 36 are also more clearly seen in FIG. 4. It shows that upon failure of pin 30 or 32 the load from links 16 or 20 can be transferred to the curved areas 34 or 36. In view of the close proximity of the ends 38 and 40, a failure of either pin 30 or 32 when slip 26 is in contact with the casing could also be absorbed by one end 38 abutting end 40 while bearing against the curved areas 34 or 36.

The slips 26 can be curved to better conform to the casing inner wall. The gap between pins 30 and 32 can be increased to allow making the slip 26 taller to increase its contact area with the casing. The guiding of the movement as between links 16 and 20 allows the slips 26 to move outwardly in a flush orientation to the casing wall for a maximum secure grip. The gears 42 and 44 can be replaced with a friction contact between links 16 and 20, although a more positive displacement type of contact like meshing gears 42 and 44 or guide links such as 46 and 52 are preferred. The advantage of the present invention over the prior systems where only the wickers at the end of a tilted link are used for anchoring can readily be seen. Because of the unique support system to drive a slip supported by a plurality of links, the contact area is dramatically improved so the grip is enhanced. The curved areas provide a backup incase severe loading causes a pin 30 or 32 to stretch or fail. The positive guiding of the connected links assures contact of the casing in a flush manner over a far greater area than prior designs. The holding forces are substantially increased. The guiding system for links 16 and 20 also facilitates release of the anchor A. As previously stated the anchor A can be used on a variety of downhole tools, whether run in into casing or through tubing. The method of actuating the anchor can be using any known device that can cause the required relative movement to get hubs 12 and 14 to move toward each other. Known devices that can provide the force to separate hubs 12 and 14 can accomplish release. A variety of surface treatments can be used instead of wickers 28 to enhance grip including using hardened inserts. Another advantage of the present invention is that slip 26 resists forces in opposed directions to allow simplification of the overall anchor structure. In the past, anchor structures have had to use separate anchoring mechanisms to resist forces that came from opposite directions. In the present invention the link pairs, with their associated slip can resist forces from opposed directions. The face of the slips 26 can have wickers or other surface treatments that are mirror images on a single slip to facilitate anchoring against forces from opposed directions. They can have one continuous arc or be a series of curves having different radii. Multiple hubs controlling pairs of links that have a slip holding them together as described above can be used to add additional grip. The slips would then translate out at different elevations along the body 10. The present invention is useful in high expansion applications where driving slips out with cones is insufficient to span the gap necessary to get anchoring forces against the casing.

The foregoing disclosure and description of the invention are illustrative and explanatory thereof, and various changes in the size, shape and materials, as well as in the details of the illustrated construction, may be made without departing from the spirit of the invention.

I claim:

1. A high expansion anchor system for a tool, for selective contact with a tubular downhole, comprising:

a body having a longitudinal axis;

at least one slip assembly mounted to said body, said slip assembly comprising:

a linkage pivotally movable with respect to said body between a retracted and an expanded position; and a slip mounted to said linkage, said slip having a contact surface treatment such that movement of said linkage to said expanded position where said surface treatment of said slip contacts the tubular allows said surface treatment to resist forces applied to said body from opposed directions.

2. The anchor system of claim 1, wherein:

said slip translates, without rotation, to contact the tubular as a result of said pivotal movement of said linkage.

3. The anchor system of claim 2, wherein:

said slip moves substantially perpendicularly to the longitudinal axis of said body.

4. The anchor system of claim 2, wherein:

said linkage comprises a first and second links pivotally connected to said slip by pins.

5. The anchor system of claim 4, wherein:

said first and second links are guided, by a guide mechanism independent of said pins and said slip, in their pivotal movement to limit the movement of said slip to purely translation.

6. The anchor system of claim 4, wherein:

said slip is longer than the distance between said pins.

7. The anchor assembly of claim 4, wherein:

said first and second links are connected to said slip adjacent a first end of said links and said links are connected adjacent their opposite ends to hubs mounted to said body, said hubs movable toward each other to translate said slip outwardly toward the tubular.

8. The anchor assembly of claim 7, wherein:

said at least one slip assembly comprises a plurality of slip assemblies with each comprising a first and second link pivotally connected adjacent one end to one of said hubs and pivotally mounted at an opposite end to a slip.

9. The anchor assembly of claim 7, further comprising a plurality of slip assemblies operable between discrete pairs of said hubs so as to engage the tubular with said slips at different elevations along said body.

10. The anchor system of claim 1, wherein:

said slip has an outer face for contact with the tubular with a surface treatment oriented to oppose release from forces acting in opposite directions.

11. A high expansion anchor system for a tool, for selective contact with a tubular downhole, comprising:

a body having a longitudinal axis;

at least one slip assembly mounted to said body, said slip assembly comprising:

a linkage pivotally movable with respect to said body between a retracted and an expanded position; and a slip mounted to said linkage whereupon movement of said linkage to said expanded position said slip contacts the tubular to resist forces applied to said body from opposed directions:

said slip translates, without rotation, to contact the tubular as a result of said pivotal movement of said linkage;

said linkage comprises a first and second links pivotally connected to said slip by pins;

said first and second links are guided in their pivotal movement to limit the movement of said slip to purely translation;

said guiding of said first and second links comprises contact therebetween to insure they both pivot in equal amounts.

12. The anchor system of claim 11, wherein:

said contact comprises meshing gear teeth on said first and second links.

13. A high expansion anchor system for a tool, for selective contact with a tubular downhole, comprising:

a body having a longitudinal axis;

at least one slip assembly mounted to said body, said slip, assembly comprising:

a linkage pivotally movable with respect to said body between a retracted and an expanded position; and a slip mounted to said linkage whereupon movement of said linkage to said expanded position said slip contacts the tubular to resist forces applied to said body from opposed directions;

said slip translates, without rotation, to contact the tubular as a result of said pivotal movement of said linkage;

said linkage comprises a first and second links pivotally connected to said slit, by pins;

said first and second links are guided in their pivotal movement to limit the movement of said slip to purely translation;

said guiding of said first and second links comprises a first and a second guide links, said guide links being engaged to each other in a manner permitting relative movement between them.

14. The anchor system of claim 13, wherein:

said first guide link is pivotally mounted to said first link and said second guide link is pivotally mounted to said second link;

said guide links are engaged to each other via a pin in one extending through a slot in the other.

15. A high expansion anchor system for a tool, for selective contact with a tubular downhole, comprising:

a body having a longitudinal axis:

at least one slip assembly mounted to said body, said slip assembly comprising;

a linkage pivotally movable with respect to said body between a refracted and an expanded position: and a slip mounted to said linkage whereupon movement of said linkage to said expanded position said slip contacts the tubular to resist forces applied to said body from opposed directions;

said slip translates, without rotation, to contact the tubular as a result of said pivotal movement of said linkage;

said linkage comprises a first and second links pivotally connected to said slip by pins:

said slip is longer than the distance between said pins;

said slip comprises an outer face having at least one curve to enhance contact area with the tubular.

16. A high expansion anchor system for a tool, for selective contact with a tubular downhole, comprising:

a body having a longitudinal axis;

at least one slip assembly mounted to said body, said slip assembly comprising:

a linkage pivotally movable with respect to said body between a retracted and an expanded position; and a slip mounted to said linkage whereupon movement of said linkage to said expanded position said slip contacts the tubular to resist forces applied to said body from opposed directions;

said slip translates, without rotation, to contact the tubular as a result of said pivotal movement of said linkage;

said linkage comprises a first and second links pivotally connected to said slip by pins;

said slip, is longer than the distance between said pins;

said slip comprises at least one interior surface adjacent said pin for load transfer from said slip to at least one of said first and second links should said pin holding that link to said slip weaken or fail under load.

17. The anchor system of claim 16, wherein:

said interior surface conforms to the shape of the end of said link that is disposed adjacent to it.

18. The anchor system of claim 17, wherein:

said at least one interior surface comprises a plurality of arcuate surfaces each accepting a similarly shaped end of said link but in a spaced apart relationship when said pin joining said link to said slip is operative.

19. A high expansion anchor system for a tool, for selective contact with a tubular downhole, comprising:

a body having a longitudinal axis;

at least one slip assembly mounted to said body, said slip assembly comprising:

a linkage pivotally movable with respect to said body between a retracted and an expanded position; and a slip mounted to said linkage whereupon movement of said linkage to said expanded position said slip contacts the tubular to resist forces applied to said body from opposed directions;

said linkage comprises a first and second links pivotally connected to said slip by pins;

said first and second links are guided by contact therebetween to allow them to pivot in substantially equal amounts.

20. A high expansion anchor system for a tool, for selective contact with a tubular downhole, comprising:

a body having a longitudinal axis;

at least one slip assembly mounted to said body, said slip assembly comprising:

a linkage pivotally movable with respect to said body between a retracted and an expanded position; and a slip mounted to said linkage whereupon movement of said linkage to said expanded position said slip, due to translation, contacts the tubular to resist forces applied to said body from opposed directions;

said linkage comprises a first and second links pivotally connected to said slip by pins;

a first and a second guide links, respectively connected to said first and second links, said guide links being engaged to each other in a manner permitting relative movement between them.

21. A high expansion anchor system for a tool, for selective contact with a tubular downhole, comprising:

a body having a longitudinal axis;

at least one slip assembly mounted to said body, said slip assembly comprising:

a linkage pivotally movable with respect to said body between a retracted and an expanded position; and a slip mounted to said linkage whereupon movement of said linkage to said expanded position said slip contacts the tubular to resist forces applied to said body from opposed directions;

said slip comprises an outer face having at least one curve to enhance contact area with the tubular.

22. A high expansion anchor system for a tool, for selective contact with a tubular downhole, comprising:

a body having a longitudinal axis;

at least one slip assembly mounted to said body, said slip assembly comprising:

a linkage pivotally movable with respect to said body between a retracted and an expanded position; and a slip mounted to said linkage whereupon movement of said linkage to said expanded position said slip contacts the tubular to resist forces applied to said body from opposed directions;

said linkage comprises a first and second links pivotally connected to said slip by pins;

said slip comprises at least one interior surface adjacent said pin for load transfer from said slip to at least one of said first and second links should said pin holding that link to said slip weaken or fail under load.

* * * * *